United States Patent [19]

Coleman

[11] Patent Number: 4,787,365

[45] Date of Patent: Nov. 29, 1988

[54] DOUBLE WALLED FIREPLACE INSERT AND METHOD FOR LOADING FROM THE OUTSIDE

[76] Inventor: Dwight E. Coleman, HC83 Box 20, Virgie, Ky. 41572

[21] Appl. No.: 119,630

[22] Filed: Nov. 12, 1987

[51] Int. Cl.[4] ..... F24B 7/00

[52] U.S. Cl. ..... 126/521; 126/531; 126/533; 126/538; 126/539; 126/545; 126/549; 237/52

[58] Field of Search ..... 126/120, 121, 73, 126, 126/125, 127, 137, 139, 146; 237/53, 51, 55, 52

[56] References Cited

U.S. PATENT DOCUMENTS

| | | | |
|---|---|---|---|
| 4,003,362 | 1/1977 | Lerner | 126/121 |
| 4,136,665 | 1/1979 | Steffen | 126/126 |
| 4,194,688 | 3/1980 | Cobos | 126/121 |
| 4,263,888 | 4/1981 | Pitts | 126/123 |
| 4,351,315 | 9/1982 | Babbage | 126/73 |
| 4,576,141 | 3/1986 | Lillard | 126/120 |

*Primary Examiner*—James C. Yeung
*Attorney, Agent, or Firm*—Scott R. Cox

[57] ABSTRACT

A double walled fireplace insert is shown with an inner firebox and an outer shell to provide convection air channels between the parallel walls of the inner and outer units. A front panel is integral with the outer shell, and it covers the front of the insert. This front panel has room air intake vents that open into the said air channels, and warmed air outlet vents that open into the room to be heated by this fireplace. There is a circulating fan positioned within the convection air channels for governing the air movement through the said channels. Each of the rear walls of the insert has a pivoted heavy metal door to accommodate the rear loading of the interior firebox when there is a vertical masonry chimney built on the outside of the residence over the fireplace insert installed through the outer wall with a door opening in the lower portion thereof for gaining access to the two rear doors of the fireplace insert so that firewood may be loaded from the outside into the firebox through the open rear doors, and ashes and cinders may be collected and removed through these two rear door openings from the outside after the fire has subsided. A lock mechanism is provided for the outer rear door to prevent unauthorized entry by unknown persons.

5 Claims, 3 Drawing Sheets

86
84
78
62
84
63
66
79
60
82
56
64
50
54
64
10
64
48
58
52
70
53
72
75
76
74
55
64
40
14
36
22
12
44

DOUBLE WALLED FIREPLACE INSERT AND METHOD FOR LOADING FROM THE OUTSIDE

BACKGROUND OF THE INVENTION

1. Field of the Invention:

This invention relates to the art of fireplace inserts and, particularly, to double wall fireplace inserts that have convection air channels between the firebox and an outer shell to improve the thermal efficiency of the fireplace so that the insert serves as a heat exchanger between the hot walls of the inner firebox and the circulating air.

2. Description of the Prior Art: A careful search of the prior art has been made, and several patents were found to be of interest.

U.S. Pat. No. 4, 351,315 to Babbage apparently was developed in England, and it covers a solid fuel boiler that apparently is burning fossil fuel such as coal rather than firewood, as the present invention. This solid fuel boiler is mounted in the wall divider that may be an exterior wall of the building, or it may divide two interior rooms. This solid fuel boiler has a flue hopper. Also, there is a cooling water jacket around the flue ways so that water must be furnished with this solid fuel boiler, and that's not true in the present invention which uses convection air currents for transferring the heat back to the room to be heated.

The next patent is U.S. Pat. No. 4,576,141 to Lillard. It describes a fireplace apparatus where there is an ash drawer which is removable without opening the fireplace door. This ash drawer is very small, and there is not enough space to load firewood through the drawer opening in which the ash drawer sits. The firebox is mounted on four vertical legs. Each leg has a wheel on the bottom making the firebox movable. This is not a very desirable design, and it would not compete with the present invention.

OBJECTS OF THE PRESENT INVENTION

The principal object of the present invention is to provide a double walled fireplace insert that is provided with a pair of swinging rear doors which may be opened from the outside for loading firewood into the firebox from the outside of the building as well as for cleaning out the ashes and cinders in the firebox from the outside.

A further object of the present invention is to provide a double walled fireplace insert with convection air flowing around the outside of the firebox for improved thermal efficiency so that the least amount of heat is wasted going up the chimney, rather than returning into the room to be heated.

A further object of the present invention is to provide a double walled fireplace insert with leading and cleaning from the outside so as to reduce the likelihood of soiling the carpet in front of the fireplace in the room to be heated when ashes are being removed from the firebox.

SUMMARY OF THE INVENTION

The present invention provides a double walled fireplace insert comprising an inner firebox and an outer shell provided with convection air channels between the parallel walls of the inner and outer units. A front panel is integral with the outer shell for covering the front of the said insert. The front panel has room air intake vents that open into these air channels and warmed air outlet vents that are open into the room to be heated by this fireplace. A circulating fan is positioned within the convection air channels for governing the air movement through the channels. Each of the double rear walls of the insert has a pivoted heavy metal door to accommodate the rear loading of the interior firebox of the insert from the outside of the building when the fireplace has a masonry chimney built on the outside of the residence over the fireplace insert that extends through an opening in the outer wall of the residence. The lower portion of the chimney has a large door opening for gaining access to these two movable rear doors of the fireplace insert whereby firewood may be loaded from the outside into the firebox through the open rear doors, and ashes and cinders may likewise be collected and removed from the outside through these two rear door openings after the fire has subsided upon the complete ignition of the firewood within the firebox.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENTS

Figure 2:
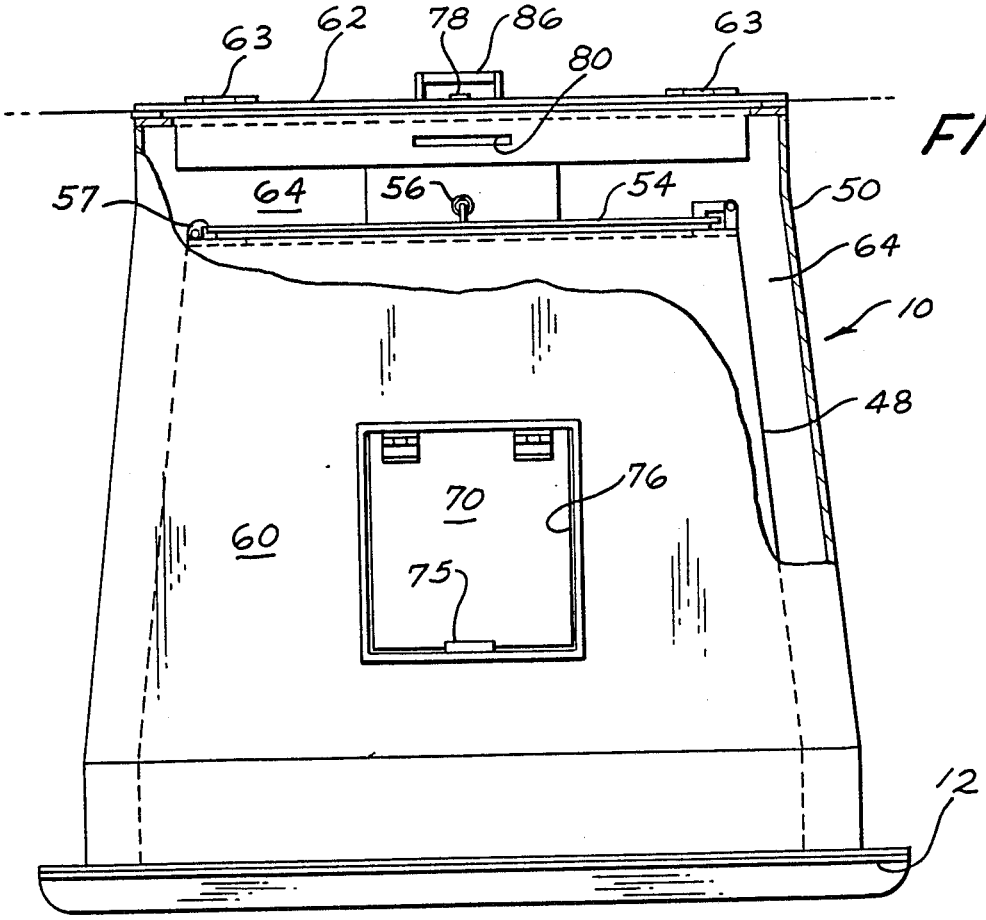
FIG. 2 is a top view of the fireplace insert of FIG. 1, with a part of the top wall broken away.

Turning now to a consideration of the drawings and, in particular, to the front elevational view of the double walled fireplace insert 10 of the present invention, as well as the top, plan view of the insert in FIG. 2, a front panel 12 covers the front of the insert, and it is provided with a front pair of swinging doors 14 and 16. Each door is provided with a pane of high temperature glass 18 so that the fire within the insert may be viewed by a person within the room that is to be heated by this fireplace. The right hand door 14 is provided with a small damper 20 to allow room air to pass into the firebox so as to support combustion. This damper 20 cooperates with a room air intake opening 22. The left hand door 16 has a similar room air intake opening 24, and it also has a small damper 20 for opening and closing this opening. The right hand door 14 has vertical side hinges 28 and 30, and the left hand door 16 has vertical side hinges 32 and 34. Each swinging door 14 and 16 has a small door knob 36 to assist in moving either door between an opened position and a closed position. At the right side of the front panel 12 is a room air inlet opening 38, and at the top portion of the front panel 12 are two warmed air outlet openings 40 and 42. The lower portion of the front panel 12 also has a room air inlet opening 44, and the left side of the front panel 12 has another warmed air outlet opening 46. Other arrangements of these openings could easily be made.

Figure 1:
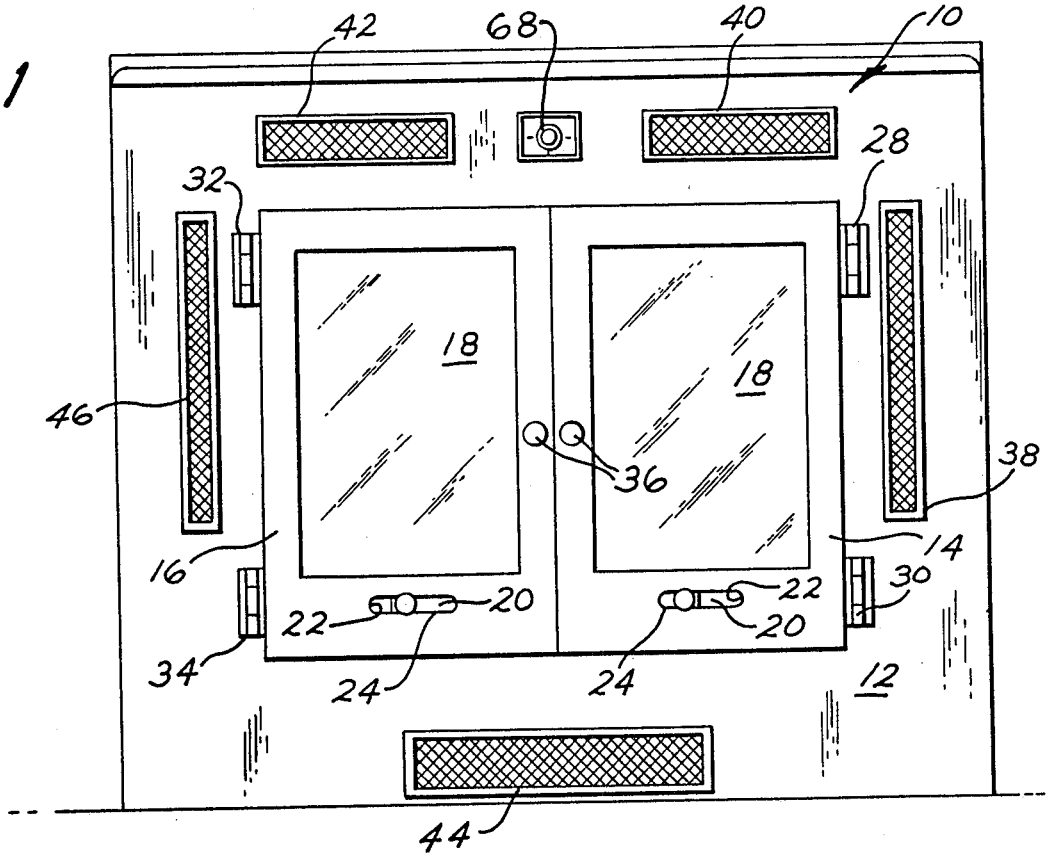
FIG. 1 is a front elevational view of the double walled fireplace insert of the present invention.
Figure 3:
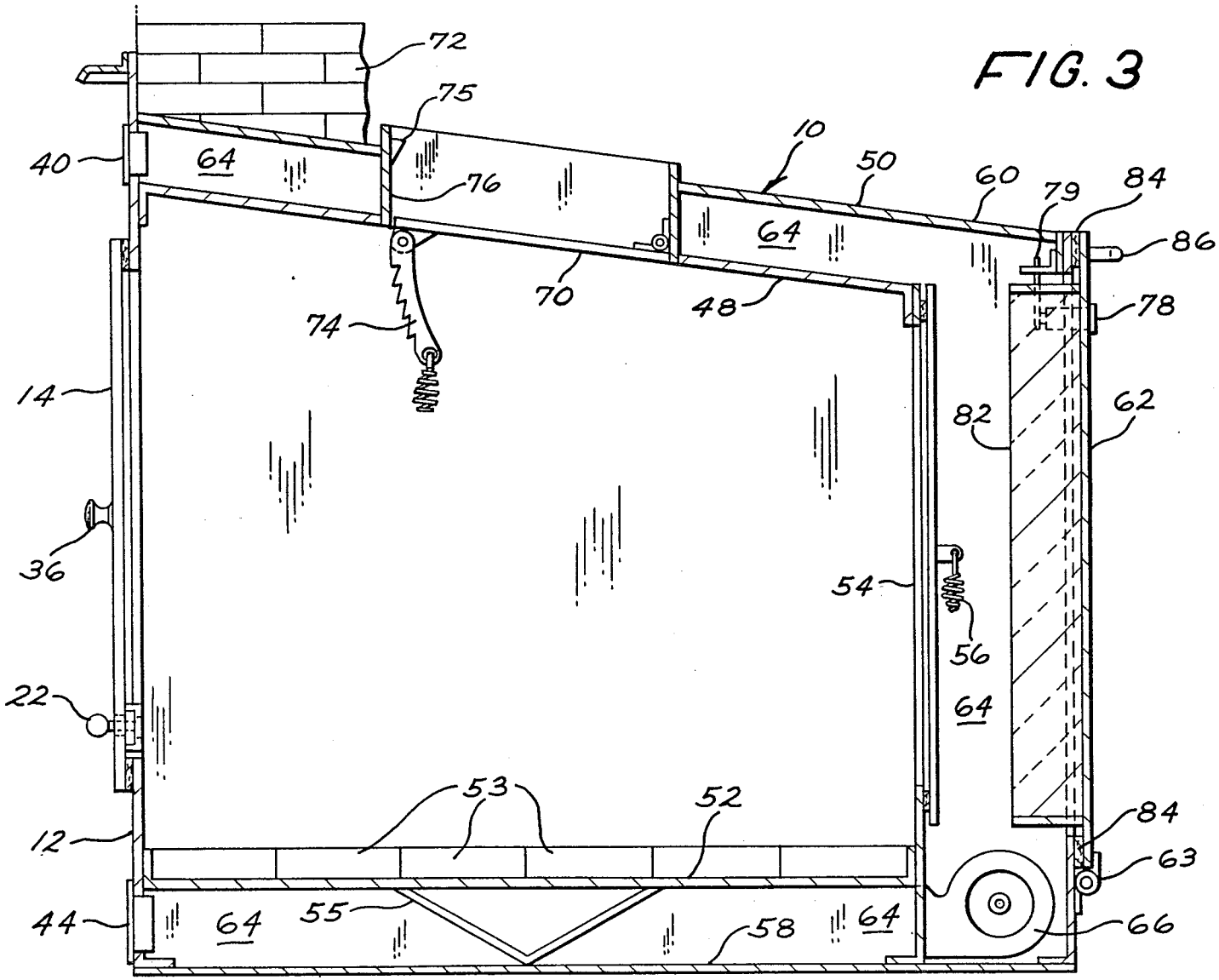
FIG. 3 is a cross-sectional, right side, elevational view of the double walled fireplace insert of the present invention showing the inner firebox surrounded by the outer shell and establishing convection air channels between the parallel walls thereof.
Figure 4:
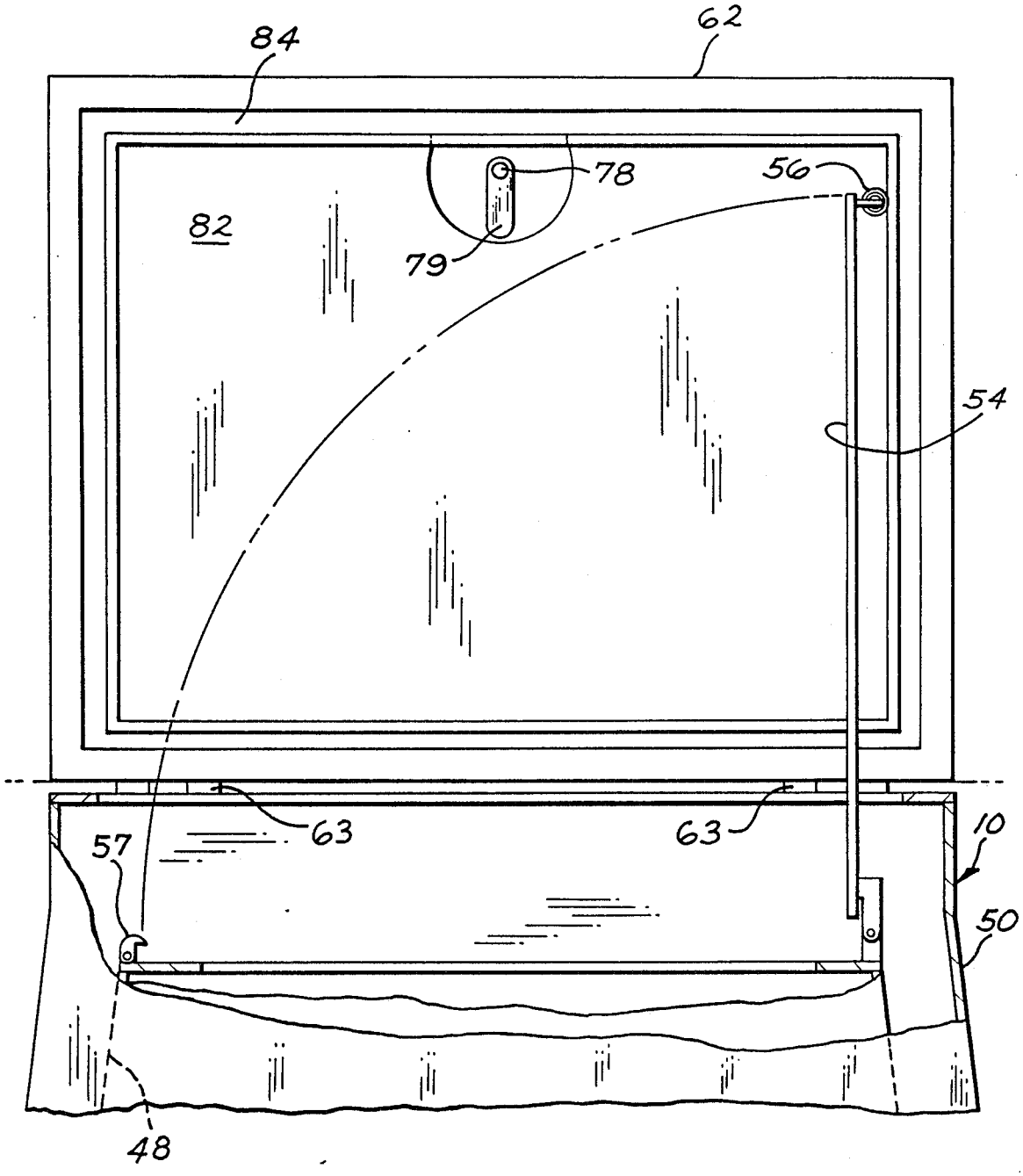
FIG. 4 is a top, cross-sectional, plan view of the fireplace insert that shows the rear inside door of the firebox in a vertical open position, and it shows the rear outside door of the outer shell in a horizontal open position to show that the outside rear door has to be opened first before the inside rear door of the firebox can be opened.

FIG. 3 shows a right side, cross-sectional, elevational view of this double walled fireplace insert 10, which is provided with an outer shell 50 surrounding an inner firebox 48 having a bottom wall 52 and a swinging rear door 54, which is hinged on one side for swinging from right to left. This bottom wall 52 of the firebox is lined on the inside with a single layer of firebricks 53 which establishes a floor for supporting the grate (not shown). The bottom wall 52 is also provided with reinforcement channel members 55 welded to the underside thereof. These channel members 55 are of short length so as not to block the convection air flow in the convection air channels 64. Also, the rear door 54 has a door pull handle 56 on the outer surface. As is shown in FIGS. 2 and 4, a small spring catch 57 is mounted on the exterior of the rear wall of the firebox 48 to hold the inner rear door 54 in its closed position. The outer shell 50 has a bottom wall 58, a top wall 60, and a rear exterior door 62, which is shown hinged along its bottom edge, as at 63. It should be understood that the rear door 62 could be made to swing from its left side from right to left, the same as the inner door 54. Notice, particularly, that convection air channels 64 are created when the inner firebox 48 is inserted into the outer shell 50. Notice, also, in the lower rear corner of this fireplace insert that there is an elongated blower fan 66 which is provided to control the movement of convection air through the convection air channels 64. A small ON/OFF switch 68 is mounted in the front panel 12 to control the operation of this fan 66. This switch is shown near the top of the front panel for ease of operation, but it could be positioned elsewhere. Room air is brought into the convection air channels through the room air inlet opening 38 as well as in through air inlet opening 44, as explained above in the description of the front panel 12 shown in FIG. 1. the principle of operation here is to bring in the room air to wash over the outside of the hot walls of the inner firebox 48 and become warm before returning to the room to be heated by this fireplace through the warmed air outlet openings 40 and 42.

As is seen in FIG. 3, the upper wall of the inner firebox 48 has a hinged damper 70 to allow the combustion gases and smoke to rise upwardly from the firebox into the overlying masonry chimney 72. A handle 74 is pivoted to the damper for opening and/or closing the damper as in many standard fireplaces. A small ledge 75 is formed within the damper duct 76 for supporting the handle 74 in a raised position and the damper in an opened position. This handle 74 can be reached through the open front doors 14 and 16. Of course, another kind of damper could be provided with an extension rod handle that extends outwardly into the room through a suitable opening (not shown) in the front panel 12.

It is important to provide the outer rear door 62 of the outer shell 50 with a key lock 78 to prevent the unauthorized entry into the residence by unknown persons after the fire in the insert 10 has been extinguished. This key lock 78 has a radial latch 79 that cooperates with a keeper slot 80, as seen in FIGS. 2 and 3.

A layer of thermal insulation 82 is attached to the inner surface of the outer rear door 62 to reduce the heat loss to the atmosphere. In addition, there is a thermal door gasket 84 around the inner periphery of the outer rear door, again to prevent heat loss to the atmosphere, as well as to prevent the cold outside air from entering the convection air channels 64. A door handle 86 is provided near the top portion of the outer rear door 62 for opening and lowering the door, as well as for raising the door into its closed position as shown in FIGS. 2 and 3.

Modifications of this invention will occur to those skilled in this art. Therefore, it is to be understood that this invention is not limited to the particular embodiments disclosed but that it is intended to cover all modifications which are within the true spirit and scope of this invention as claimed.

What is claimed is:

1. A method of loading firewood into an interior firebox of a double walled fireplace insert comprising an inner firebox containing a rear wall, side walls, a top wall and a bottom wall and an outer shell containing a rear wall, side walls, a top wall, a bottom wall, and a front wall wherein the insert is provided with convection air channels between the adjacent walls of the inner firebox and the outer shell, wherein the rear wall of the inner firebox has a swinging rear door, and the rear wall of the outer shell has a hinged rear door to allow the inner rear door to swing open, and a vertical masonry chimney is built on the outside of a building in which the fireplace insert is installed, wherein the chimney has a door opening in its lower portion for allowing access to the two rear doors so they may swing open to load firewood into the firebox, as well as for cleaning out ashes and cinders that may be formed, wherein a lock mechanism is provided for the rear door of the outer shell to prevent unauthorized entry by unknown persons wherein the rear door of the outer shell is also provided with thermal insulation to reduce heat loss from the inner firebox and a thermal door gasket to prevent cool outside air from mixing with the convection air that flows around the convection air channels.

2. A double walled fireplace insert comprising an inner firebox containing a rear wall, side walls, a top wall and a bottom wall and an outer shell containing a rear wall, side walls, a top wall, a bottom wall, and a front wall wherein the insert is provided with convection air channels between the adjacent walls of the inner firebox and outer shell, a front panel integral with the front wall of the outer shell for covering the front of said insert, said panel having room air intake vents that open into said air channels, warm air outlet vents, and a circulating fan positioned within the convection air channels for governing the air movement through said channels, each of the adjacent rear walls having a pivoted heavy metal door to accommodate the rear loading of the inner firebox of the insert from the outside of the building, wherein the insert is located within a vertical outside chimney, wherein firewood may be loaded from the outside into the firebox through the open rear doors, and ashes and cinders may be collected and removed through these two rear door openings from the outside.

3. The double walled fireplace insert as recited in claim 2 wherein the heavy metal door of the rear wall of the outer shell is provided with thermal insulation to reduce heat loss through and around the rear door.

4. The double walled fireplace insert as recited in claim2 wherein the heavy metal door of the rear wall of the outer shell has a hinge means for opening the heavy metal door arranged along its bottom edge, while the heavy metal door of the rear wall of the inner firebox also has a hinge means arranged along one side edge thereof.

5. The double walled fireplace insert as recited in claims 1 or 2 wherein the top wall of the outer shell and the top wall of the inner firebox are provided with a vertical flue duct directed into said chimney, a movable damper associated with said flue duct, a manual control means connected to said damper and an electrical switching means attached to the front wall of the outer shell for controlling said circulating fan within the convection air channels of said fireplace insert.

* * * * *